US010987675B2

(12) United States Patent
Chee et al.

(10) Patent No.: US 10,987,675 B2
(45) Date of Patent: Apr. 27, 2021

(54) DEHYDRATION AND DISINTEGRATION APPARATUS AND SYSTEM

(71) Applicants: Marcus J K Chee, Kuala Lumpur (MY); Poh Yoke Yong, Kuala Lumpur (MY)

(72) Inventors: Marcus J K Chee, Kuala Lumpur (MY); Marilyn Wenglok Chee, Kuala Lumpur (MY)

( * ) Notice: Subject to any disclaimer, the term of this patent is extended or adjusted under 35 U.S.C. 154(b) by 0 days.

(21) Appl. No.: 16/499,025

(22) PCT Filed: Jun. 12, 2018

(86) PCT No.: PCT/MY2018/000022
§ 371 (c)(1),
(2) Date: Sep. 27, 2019

(87) PCT Pub. No.: WO2019/231311
PCT Pub. Date: Dec. 5, 2019

(65) Prior Publication Data

US 2020/0398284 A1 Dec. 24, 2020

(30) Foreign Application Priority Data

May 31, 2018 (MY) ..... PI 2018702120

(51) Int. Cl.
*B02C 18/16* (2006.01)
*B02C 13/16* (2006.01)
(Continued)

(52) U.S. Cl.
CPC ..... *B02C 13/16* (2013.01); *B02C 13/288* (2013.01); *B02C 19/18* (2013.01); *B02C 23/12* (2013.01);
(Continued)

(58) Field of Classification Search
CPC ..... B02C 13/12; B02C 13/16; B02C 13/288; B02C 19/18; B02C 23/12; B02C 23/32; B02C 23/34
See application file for complete search history.

(56) References Cited

U.S. PATENT DOCUMENTS 5,839,671 A * 11/1998 Sand ..... B02C 13/16 241/24.1
6,024,307 A * 2/2000 Sand ..... B02C 13/16 241/152.2
(Continued)

FOREIGN PATENT DOCUMENTS

CN 205966124 U 2/2017
CN 107413482 A 12/2017

*Primary Examiner* — Faye Francis
(74) *Attorney, Agent, or Firm* — Argus Intellectual Enterprise; Jordan Sworen; Daniel Enea

(57) ABSTRACT

An apparatus for reducing the size of a solid material into smaller particles having an implosion chamber for containing the solid material and creating turbulence and ultrasonic soundwaves. The soundwaves generated by a flail propeller bounce off the chamber walls to create sound frequencies causing the expansion of moisture particles in the solid material leading to implosion of moisture particles within the solid material. The implosion thereby results in reducing the size of solid material, wherein a separating section that receives the smaller material from the implosion chamber channels the coarser particles back into the chamber to go through additional disintegration process. The rotation of the flail propeller within the chamber causes the moisture particles of the solid material to oscillate at high frequency and expansion that disintegrates the solid material. During this process, the moisture content is converted into vapor.

18 Claims, 2 Drawing Sheets

(51) Int. Cl.

| | |
|---|---|
| ***B02C 13/288*** | (2006.01) |
| ***B02C 19/18*** | (2006.01) |
| ***B02C 23/12*** | (2006.01) |
| ***B02C 23/16*** | (2006.01) |
| ***B02C 23/32*** | (2006.01) |
| ***F26B 1/00*** | (2006.01) |
| ***F26B 3/10*** | (2006.01) |
| ***F26B 5/02*** | (2006.01) |
| *B02C 13/28* | (2006.01) |

(52) U.S. Cl.
CPC ..... *B02C 23/16* (2013.01); *B02C 23/32* (2013.01); *F26B 1/005* (2013.01); *F26B 3/10* (2013.01); *F26B 5/02* (2013.01); *B02C 2013/2816* (2013.01)

(56) References Cited

U.S. PATENT DOCUMENTS

| | | | | |
|---|---|---|---|---|
| 6,039,277 | A * | 3/2000 | Hamm | B02C 13/16 241/1 |
| 6,682,005 | B2 * | 1/2004 | Kantonen | B02C 13/16 241/5 |
| 2002/0179751 | A1 * | 12/2002 | Kantonen | C22B 11/00 241/19 |

* cited by examiner

DEHYDRATION AND DISINTEGRATION APPARATUS AND SYSTEM

FIELD OF INVENTION

The present invention generally relates to apparatuses for reducing the size of materials; and more particularly to pulverising waste materials such that the materials can be reduced into powder form with substantially lessened moisture content.

BACKGROUND

A pulveriser or grinder has been used in numerous industries to reduce the size of solid materials, including waste materials into smaller particles to facilitate disposal or to be subjected to subsequent processes such as; chemical process, burning, or even treatments for producing sustainable end-products. Most machines are adapted for crushing or grinding large chunks of solid materials into smaller particles with a rotating or propelling cutter, hammer mills, rollers or tubular ball crushers, whereby usually the resulting particles are in a range of sizes thus not uniform in size and still consists of large chunks. It is desirable that, and more particularly in the waste disposal and management industries, the solid materials are reduced into fine and uniform particles for ease of disposal or for undergoing subsequent processes. Although several machines exist for pulverising solid materials into finer particles, these machines are relatively slow in processing and frequently have large power requirements.

An object of the present invention is to provide an apparatus for disintegrating solid materials into fine particles, and more particularly into powder form with reduced processing time. In one embodiment, the moisture content of the particles can be substantially reduced.

SUMMARY OF INVENTION

An aspect of the present invention is an apparatus for reducing a solid material into fine particles; including powder form comprising: an implosion chamber for containing the solid material; and adapted for creating turbulence and ultrasonic soundwaves that bounce off the chamber walls at different angles; a separating section A for separating the finer particles from coarser particles; and channelling the coarser particles into the chamber to go through additional disintegration process; the implosion chamber is adapted such that it allows air carrying the disintegrated particles from outside the pulverising chamber to be channelled back into the internal inclined walls of the chamber hence permitting these particles to undergo repeating pulverising process; the implosion chamber comprises a conical member, a static propeller attached to at least one surface of the chamber and a flail propeller rotatably below the conical member and static propeller; the flail propeller and the conical member being connected to an axis within the chamber.

Preferably, the rotation of the flail propeller within the chamber is adapted for generating ultrasonic soundwaves causing moisture particles of the solid material to oscillate at high frequency causing the expansion of moisture particles that leads to cavitation and disintegration of the material into finer particles, and conversion of moisture into vapour.

Preferably, the apparatus further includes a variable speed fan for facilitating in circulating the material within from within the chamber to the separating section A.

Preferably, the separating section A facilitates the separation of lighter and heavy particles within the apparatus.

Preferably, the chamber includes mass distributor and mass circulator providing surface area for bouncing ultrasound at different angles that leads to the formation of varying patterns.

Preferably, static propeller includes a plurality of metal plate members being peripherally and outwardly attached to a lower surface of the chamber.

Preferably, the flail propeller includes a plurality of flexible members having one end connected to such that they are rotatable about the axis; and cooperates with the static propeller to provide energy to facilitate the pulverising and disintegration of the material.

Preferably, subject to the type of material introduced into the apparatus, the typical particle size distribution that can be obtained range from 80 to 400 mesh (approximately 0.2 mm to 0.04 mm) for hard non-fibrous materials.

Preferably, the apparatus further comprises an inlet for entry of the solid material, and an inlet for injecting moisture into the apparatus.

Preferably, the apparatus further includes a separation column/passageway adapted to channel the disintegrated material to the separating section A.

BRIEF DESCRIPTION OF DRAWINGS

The present invention features, objects and advantages thereof may be best understood by reference to the following detailed description when read with accompanying drawings in which.

DETAILED DESCRIPTION

Figure 1:
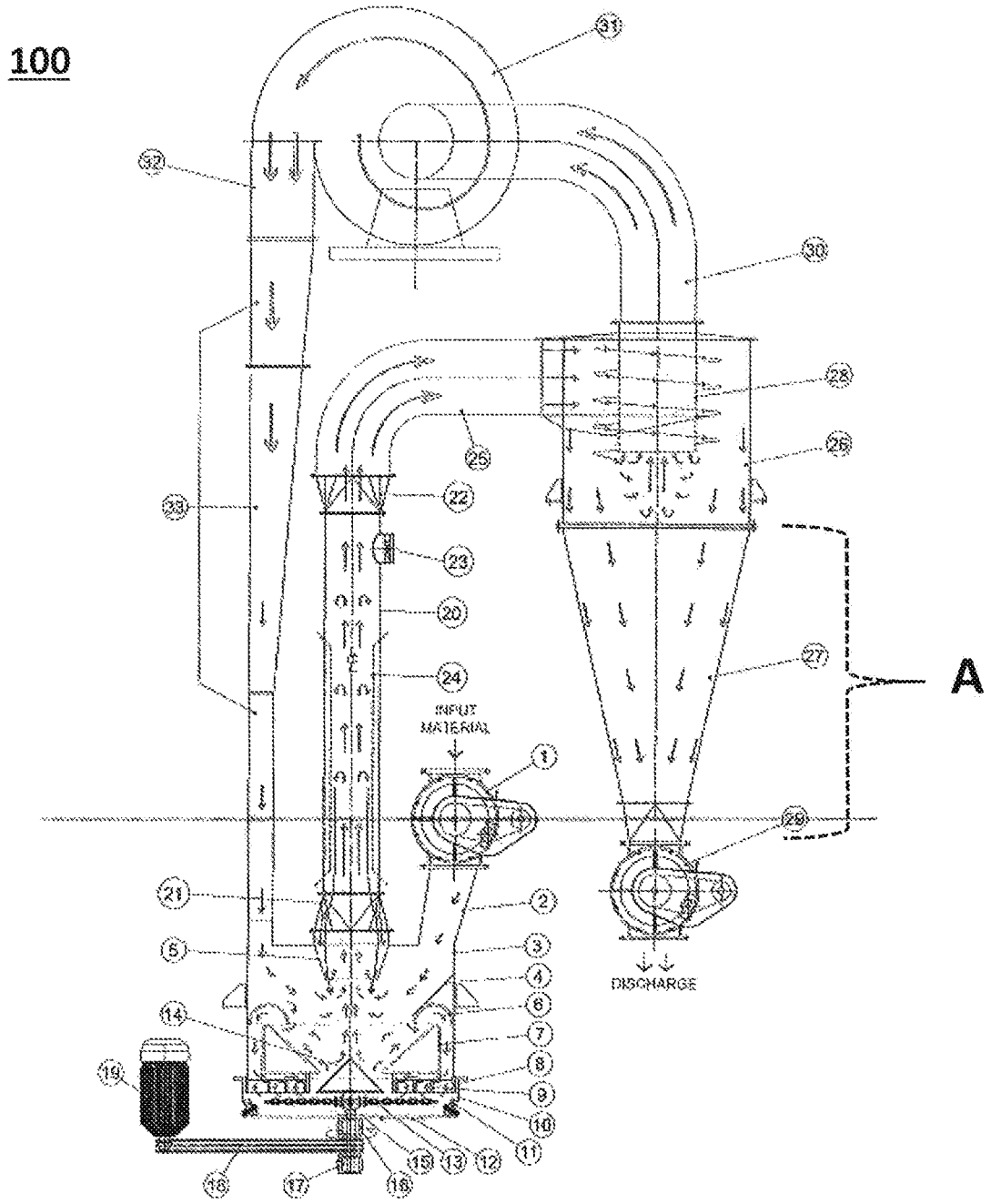
FIG. 1 provides a schematic view of the pulveriser apparatus in accordance with an embodiment of the present invention.

In line with the above summary, the following description of a number of specific and alternative embodiments is provided to understand the inventive features of the present invention. It shall be apparent to one skilled in the art, however that this invention may be practiced without such specific details. Some of the details may not be described at length so as not to obscure the invention. For ease of reference, common reference numerals will be used throughout the figures when referring to the same or similar features common to the figures.

Referring to FIG. 1, a the size reduction apparatus 100 in accordance with an embodiment of the present invention comprises: a pulverising/implosion chamber 3 provided for containing the solid material to be dehydrated and reduced into smaller or finer particles; and preferably into powder form; an inlet 1 in the form of a sluice valve connected to a passageway 2 for directing the material into the chamber 3; an ultrasonic soundwave generator for ultrasonic soundwaves that bounce off the chamber walls at different angles to create high frequency vibration leading to cavitation and implosion hence dehydrating as well as reducing the solid material into powder form; a separating section comprising a cyclone exhaust head 26 and cyclone setting cone 27 for separating the finer particles from coarser particles; and channelling the coarser particles into the chamber 3 to go through another reducing process.

The chamber 3 is circular in shape comprising at least one conical member 14 secured to at least inner surface of the chamber, a circulator section that comprises a flow enhancement plate and mass circulator 4, 6 and a mass distributor 7. The circulator section is generally a hemispherical cross section with a peripheral open surface along its length to allow movement of particles therein. The peripheral opening is adapted so as to allow air and particles that have escaped from a bottom area of the implosion chamber 3, to be channelled back into the conical member 14 of the implosion chamber 3 hence permitting these particles to undergo repeating dehydration and pulverising process. An inlet 1 is positioned on one surface of the chamber 3, preferably adapted such that it is connected to a passageway 2 that leads into the chamber 3.

The mass distributor 7 is generally circular with a diameter slightly smaller than that of the chamber 3. In the preferred embodiment, the mass distributor 7 includes an angled or inclined wall hence providing more surface area for the movement of the particles being processed therein. In the preferred arrangement, the mass circulator 4 and the flow enhancement plate are positioned above the mass distributor 7.

Both of the flow enhancement plate and the mass circulator 4, 6 of the implosion chamber 3 includes a central opening accordingly sized to receive and permits a conical or pyramid member 14.

The conical member 14 and a static propeller 9 are attached adjacent to the bottom surface of the implosion chamber 3 and a flail propeller 13 arrangement being rotatably connected below conical member 14 and static propeller 9. The conical member and flail propeller 13 being rotatably connected to a vertical axis or a spindle shaft 15 that includes lower and upper bearings 17; so as to permit rotational movement of the conical member 14, and the flail propeller 13 about said axis for generating a combination of kinetic and high-power ultrasound waves leading to the dehydration and disintegration of the solid material into fine particles. Preferably, the flail propeller 13 is movably connected below the conical member 14.

The spindle shaft 15 is connected to one end of the conical member 14 in a manner such that the conical member 14 is able to rotate about the shaft 15 and its rotational speed is controlled by a motor 19.

Still referring to FIG. 1, the flail propeller 13 is adapted to rotate about the spindle shaft 15, resulting to the creation of turbulence at a speed sufficient to generate or produce ultrasonic sound waves that are propagated and reflected by the static propeller 9 to create the conditions to disintegrate materials that are introduced into the implosion chamber 3. The spindle shaft 15 support may include a lower bearing 17 and an upper bearing 16 allowing rotational movement. The flail propeller 13 is connected such that it can rotate relative to a horizontal plane about the spindle shaft 15.

Subject to the type of material introduced into the apparatus, the typical particle size distribution can range from 80 to 400 mesh (approximately 0.2 mm to 0.04 mm) for hard non-fibrous materials. Courser mesh will be expected from fibrous materials.

Now referring to FIG. 1, the conical member 14 may reflect a pyramid configuration such that it provides sufficient surface area for deflecting the soundwaves generated and the material towards the inclined walls of the mass distributor 7 within the chamber 3. With this arrangement the material that entered the chamber 3 undergoes rapid movement facilitated by air flow and bounced against the wall of the chamber 3. This movement of the material results to vibrational motion of the moisture particles within the material. The rotational speed of the flail propeller 13 and the conical member 14 can be regulated or varied, subject to the type of materials to be disintegrated. These changes or variation can be managed by the regulation circuit of a control system.

The static propeller 9 includes a guide rim and a plurality of metal plate members being peripherally and outwardly attached to a lower external surface of the implosion chamber 3. The static propeller 9 includes a plurality of plates affixed to the bottom portion of the chamber 3 whereby they are accordingly adapted to generate sound waves within the chamber 3 to facilitate dehydration and reduction process. In a preferred embodiment, it includes a set of fixed inclined vanes (blades) angled at multiple small cross vanes.

It is anticipated that the number of fixed plates or blades may vary. The flail propeller 13 is disposed in below the conical member 14 and includes a plurality of flexible members having one end connected to a central axis support, such that they are rotatable about the axis; and cooperates with the static propeller 9 to produce the high-power ultrasound to facilitate the pulverising and disintegration of the material.

The separating portion A is connected to the implosion chamber 3 via a connecting channel or a separation column 20 comprising a variable speed fan 31 disposed thereto. The separation process in accordance with a preferred embodiment includes the cyclone separating mechanism whereby the disintegrated particles are segregated based on sizes, by way of pneumatic separation, during which the coarser particles are channelled back to the implosion chamber 3 and the finer particles that are within the desired mesh are discharged via an outlet connected to the cyclone settling cone 27. In one embodiment it is conical in shape; having one open end being attached to the separation column 20 the other end is formed with a sluice valve outlet 29 for discharging the fine particles. The separating portion is further provided with passageway or duct 30 for directing the coarser materials to the fan 31. The separation column 20 is connected to a transient piece entry 22 at one end and a transient piece outlet or exit 21 on the other end, as suitable shown in FIG. 1. In one embodiment, an air speed regulator 23 is operably secured to the separation column 20 to selectively change or adjust the separation velocity. A suction and dropdown cone 5 is secured to the transient piece exit 21 to facilitate the suction of particles into the separation column 20.

The variable speed fan 31 includes a fan passageway/duct 32 adapted to channel or direct the coarser particles from the separating section A back to the implosion chamber 3. Preferably, the speed fan 31 facilitates the circulation of air and the material within the apparatus, and to facilitate the flow of the material from the chamber 3 to the separation section A. A passageway 25 and transient exit portion 22 is provided for channelling the material from the chamber 3 to the separation section A, and a return chute/passageway 33 channels the material and air flow from the variable speed fan 31 to the chamber 3.

In the embodiment as shown in FIG. 1, the apparatus 100 further includes wear resistant sound reflecting plates 11 positioned at the bottom area of the chamber 3.

Figure 2:
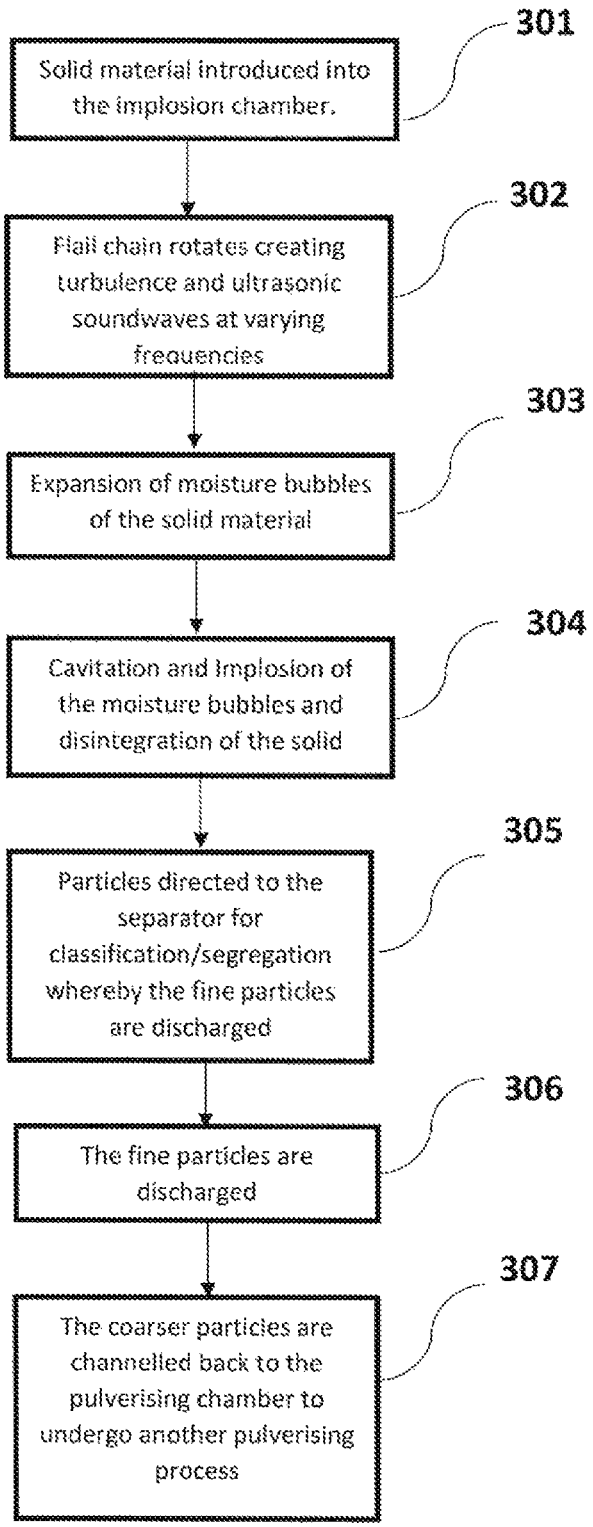
FIG. 2 provides a flowchart illustrating the steps involved in the operational effect of the pulveriser apparatus in accordance with an embodiment of the present invention.

A system incorporating the method of pulverising solid material using the apparatus in accordance with an embodiment of the present invention will now be described with reference to a flowchart depicted in FIG. 2. At 301, the solid material enters the implosion chamber 3. At the same time air flows and circulates within the apparatus 100. Next at 302, the flail propeller 13 rotates at a speed sufficient to create turbulence and ultrasonic soundwaves. This environment within the implosion chamber 3 results to the solid material entering the ultrasound concentrator where the moisture particles are oscillated at a sufficient frequency that leads to the expansion of the moisture bubbles at 303 and eventually causing cavitation of the solid particles leading to an implosion at 304, thereby disintegrating the solid material into finer particles, such as in powder form; and heat released during the process convert the moisture into vapour. The particles are directed to the separation section A at 305, at which the coarser particles are picked and channelled back to the implosion chamber 3 facilitated by fan 31 while the finer particles are picked up from the separating section A through the outlet 29, at 306. The coarser particles are channelled back into the implosion chamber 3 via the air stream or air flow created by the fan 21 at 307, to be subjected to another round of dehydrating and pulverising (which may be repeated several times until the desired particle size is obtained) so as to attain dryer and finer particles, and more particularly powder form.

In a preferred embodiment of the present invention, the ultra sound frequency can be controlled or manipulated by adjusting the rotational speed (RPM) of the flail propeller. The frequency generated in the implosion chamber of the apparatus can be considered as closely matching the natural frequency of the material to be disintegrated for more energy efficient processing.

The apparatus in accordance with the present invention can be utilised for various purposes that require drying and reduction of any given solid/partially solid materials into a finer form, such as but not limiting to, waste materials, coals, palm kernel shells, oil palm waste materials etc. The apparatus can be easily integrated with any other upstream and downstream systems; offers an environmentally friendly waste management solution or facilitate in converting wastes in high value commercial products, such as, but not limiting to, biomass fuel, fertilisers, animal feed, and soil mix.

With the apparatus of the present invention, a substantial amount of solid materials (can be a mixture from varying resources) can be dried and reduced into smaller and cleaner particles with reduced power consumption. In a preferred embodiment, the operational frequency of rotation required is below 2000, and within 800 rpm to 1500 rpm. Accordingly, the apparatus requires less energy and does not overheat; as the generation of heat during operation can be significantly reduced. The output of dried and pulverised material can be in powder form, of which may be subjected to further analysis or studies. As an example, the apparatus can reduce the size of coal into powder form with a general power requirement of 200 kW, and output of 3 to 6 tonnes per hour. The size reduction is substantially facilitated by the soundwave produced and capturing energy in the atmospheric within the chamber of the apparatus.

And it is also understood that the complete apparatus includes electronic control system which is configured and expanded to communicate with and supply power to the rotating/spindle shaft of the present invention and other mechanisms of the apparatus to realise the full functionality of the present invention.

From the foregoing, it would be appreciated that the present invention may be modified in light of the above teachings. It is therefore understood that, within the scope of the appended claims, the invention may be practiced otherwise than as specifically described.

The invention claimed is:

1. An apparatus for dehydrating and reducing a solid material into smaller particles comprising:

an implosion chamber configured to receive the solid material from an inlet;

wherein the implosion chamber comprises a conical member and a flail propeller disposed below the conical member, wherein the flail propeller is configured to generate ultrasonic soundwaves that bounce off the implosion chamber walls;

wherein the flail propeller interacts with the solid matter to form a coarse smaller particle and a fine smaller particle;

a separating section comprising a cyclone exhaust head and a cyclone settling cone, wherein the cyclone exhaust head is operably connected to the implosion chamber via a separation column;

wherein the cyclone settling cone comprises an outlet configured to discharge the fine smaller particles exterior to the apparatus and the cyclone exhaust head is configured to reintroduce the coarse smaller particles received through the separation column back to the implosion chamber;

a mass circulator extending from a sidewall of the implosion chamber and comprising a curved cross section and a peripheral open surface to allow air and the smaller particles that have escaped from a bottom area of the implosion chamber to be repeatedly channeled towards the conical member while bouncing ultrasound at different angle;

wherein the mass circulator is disposed above the conical member and the flail propeller.

2. The apparatus of claim 1, wherein the flail propeller includes a plurality of flexible members having one end connected to such that they are rotatable about a shaft; and cooperates with a static propeller disposed thereabove to provide energy to facilitate the dehydrating, pulverising and disintegration of the material.

3. The apparatus of claim 1, wherein the particle size distribution obtained ranges from 80 to 400 mesh (approximately 0.2 mm to 0.04 mm) for hard non-fibrous materials.

4. The apparatus of claim 1, wherein the apparatus reduces the solid material into a dried, powder form.

5. The apparatus of claim 1, wherein the ultrasound frequency can be adjusted by adjusting the rotational speed of the flail propeller.

6. The apparatus of claim 1, wherein the moisture content of the material can be adjusted by injecting liquid into the chamber through the inlet.

7. The apparatus of claim 1, wherein the implosion chamber further comprises a static propeller attached to a surface of the implosion chamber and comprises a guide rim and a plurality of metal plate members peripherally and outwardly attached to a lower external surface of the implosion chamber.

8. The apparatus of claim 7, wherein the static propeller is positioned entirely above the flail propeller.

9. The apparatus of claim 1, wherein the inlet is offset from a central vertical axis of the implosion chamber.

10. The apparatus of claim 1, wherein the implosion chamber further comprises a flow enhancement plate extending at a declining slope from an interior sidewall of the implosion chamber and configured to receive the solid material from the input and direct the solid material towards the conical member.

11. The apparatus of claim 1, wherein the implosion chamber further comprises a mass distributor having an inclined wall positioned around the conical member, wherein the incline slopes downward toward the conical member and the conical member is configured to deflect the soundwaves toward the inclined wall.

12. The apparatus of claim 1, wherein a back wall of the mass distributor is parallel to the sidewall of the implosion chamber.

13. The apparatus of claim 1, wherein the flow enhancement plate is disposed above the mass distributor and mass circulator.

14. The apparatus of claim 1, wherein the mass circulator comprises a central opening sized to receive the conical member.

15. The apparatus of claim 1, wherein the separation column is disposed directly above the conical member and configured to transport the solid material and the smaller particles from the implosion chamber to the separating section.

16. The apparatus of claim 1, further comprising a return chute operably connected to the cyclone exhaust and adapted to reintroduce the solid material to the implosion chamber.

17. The apparatus of claim 16, wherein the input and the return chute introduce the solid material offset from a central vertical axis of the implosion chamber.

18. The apparatus of claim 1, wherein the solid material and the smaller particles are separated in the separating section via a variable speed fan configured to separate particles based on size as determined by a speed setting of the fan.

* * * * *